US008354963B2

(12) United States Patent
Tai

(10) Patent No.: US 8,354,963 B2
(45) Date of Patent: Jan. 15, 2013

(54) LOW-PROFILE THREE-DIMENSIONAL ANTENNA

(75) Inventor: Lung-Sheng Tai, Tu-Cheng (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 686 days.

(21) Appl. No.: 12/543,233

(22) Filed: Aug. 18, 2009

(65) Prior Publication Data

US 2010/0039331 A1 Feb. 18, 2010

(30) Foreign Application Priority Data

Aug. 18, 2008 (TW) ..... 97131448 A

(51) Int. Cl.
*H01Q 1/38* (2006.01)

(52) U.S. Cl. ..... 343/700 MS; 343/846

(58) Field of Classification Search ..... 343/700, 343/702, 846
See application file for complete search history.

(56) References Cited

U.S. PATENT DOCUMENTS

| | | | | |
|---|---|---|---|---|
| 2,978,703 | A * | 4/1961 | Kuecken | 343/803 |
| 5,936,590 | A * | 8/1999 | Funder | 343/795 |
| 6,049,314 | A * | 4/2000 | Munson et al. | 343/846 |
| 6,114,996 | A * | 9/2000 | Nghiem | 343/700 MS |
| 7,439,935 | B1 * | 10/2008 | Rodenbeck | 343/895 |

FOREIGN PATENT DOCUMENTS

| | | |
|---|---|---|
| CN | 200962453 Y | 10/2007 |
| TW | I240450 | 5/2005 |

* cited by examiner

*Primary Examiner* — Tho G Phan
(74) *Attorney, Agent, or Firm* — Wei Te Chung; Ming Chieh Chang

(57) ABSTRACT

A multi-band antenna includes a grounding element having a side edge, a connecting element, and a radiating element. The radiating element is electrically connected to the grounding element via the connecting element, and includes a first radiating portion and a second radiating portion respectively extending from the connecting element. The connecting element includes a folded connecting arm extending along three dimensions. A slot is formed between the connecting arm and the grounding element.

20 Claims, 4 Drawing Sheets

LOW-PROFILE THREE-DIMENSIONAL ANTENNA

BACKGROUND OF THE INVENTION

1. Field of the Invention

The present invention relates generally to an antenna, specially, that the antenna is used in an electric device.

2. Description of the Prior Art

A planar inverted-F antenna is always used inside an electric device. For the electric device trending to be small and thin, the antenna inside the electric device should have the feature of small volume. TW Patent No. TW 12040450, issued to Cheng on May 1, 2005, discloses a planar inverted-F antenna. Referencing to FIG. 1 of the patent, the antenna includes a grounding element, a radiating element apart from the grounding element, and a connecting element serving to connect a radiating element and a grounding element. The connecting element includes a plurality of segments. The radiating element includes a plurality of radiating arms. However, all the segments of the connecting element and the radiating arms of the radiating element are arranged on the same plane so as to the antenna is too long.

Hence, in this art, an improved antenna to overcome the above-mentioned disadvantages of the prior art should be provided.

BRIEF SUMMARY OF THE INVENTION

A primary object, therefore, of the present invention is to provide a low-profile antenna with a three-dimensional connecting element.

In order to implement the above object, the multi-band antenna comprises a grounding element having a side edge, a connecting element, and a radiating element. The radiating element is electrically connected to the grounding element via the connecting element, and comprises a first radiating portion and a second radiating portion respectively extending from the connecting element. The connecting element comprises a folded connecting arm extending along three dimensions. A slot is formed between the connecting arm and the grounding element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
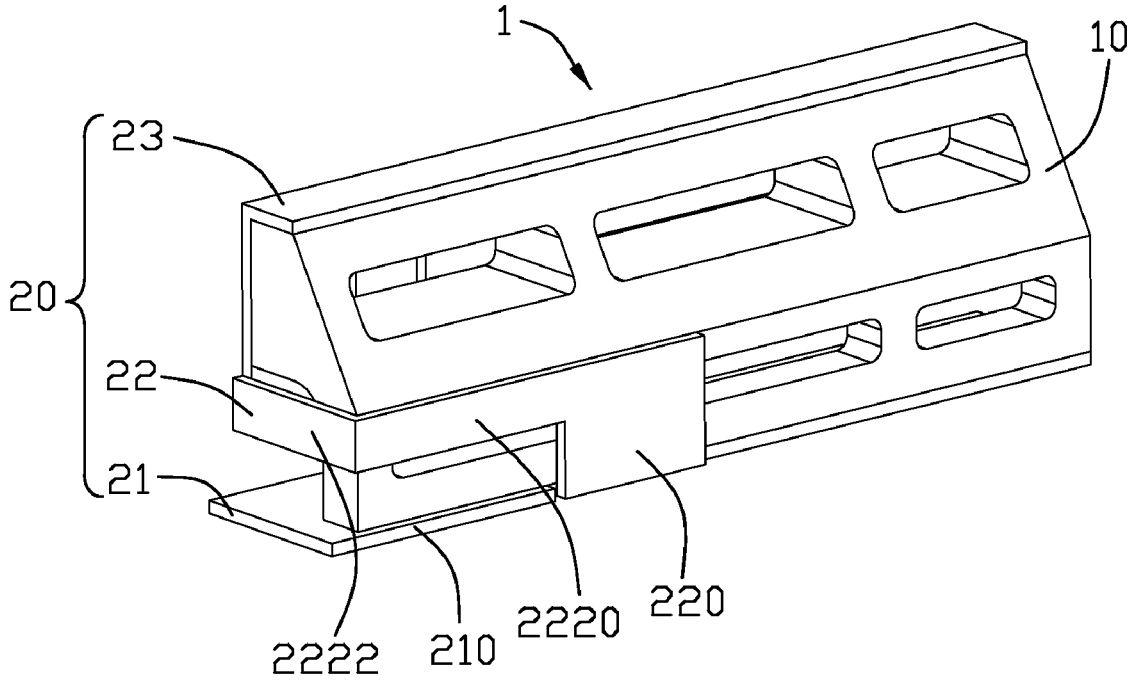
FIG. 1 is a perspective view illustrating an antenna assembly and a complementary connector according to a preferred embodiment of the present invention.
Figure 2:
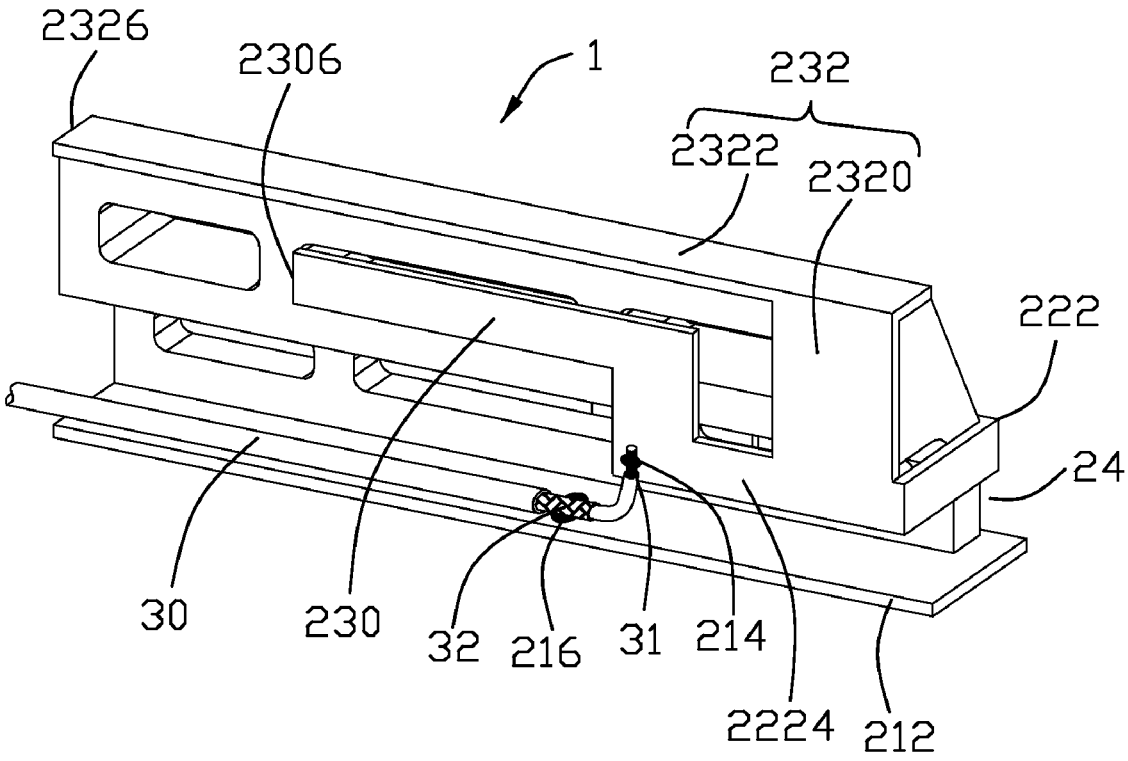
FIG. 2 is a perspective view similar to FIG. 1, but viewed from another angle.
Figure 3:
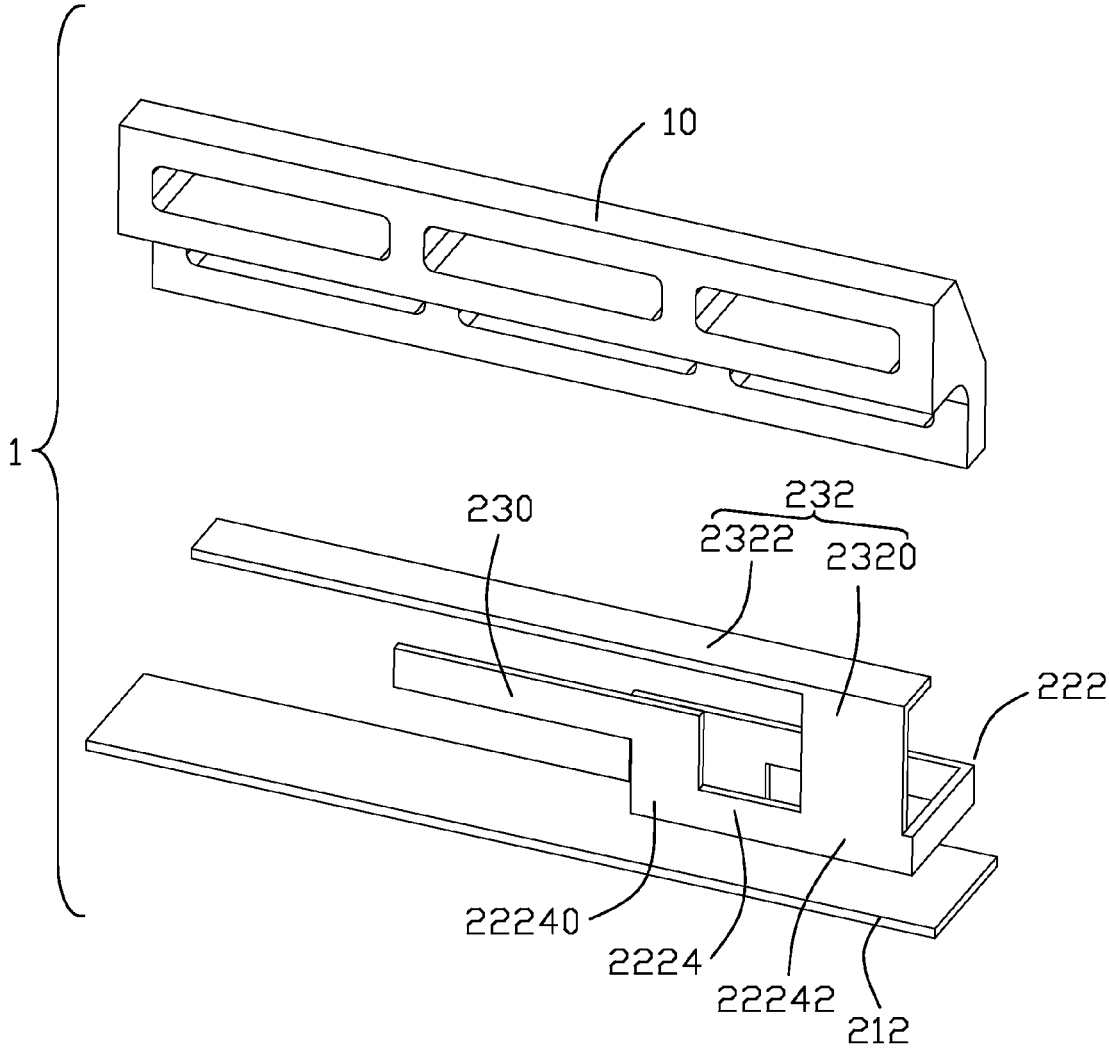
FIG. 3 is an exploded, perspective view of FIG. 2 without an feeding line.

Reference to FIGS. 1 to 3, an antenna assembly 1 comprises a supporting portion 10, an antenna 20 and a feeding line 30.

The supporting portion 10 is made from insulating material and porose structure. The supporting portion 10 has eight surfaces.

The antenna 20 is an inverted-F antenna and made from an integrated metal plate. The antenna 20 is attached on the five surfaces of the supporting portion 10, and comprises a grounding element 21 attached on a lower surface thereof, a connecting element 22 extending upward from the grounding element 21, and a radiating element 23 extending from the connecting element 22.

The grounding element 21 extends along a horizontal panel and comprises a first side edge 210 and a second side edge 212. A metal foil (not shown) is attached on an lower surface of the grounding element 21 so as to make the performance of the antenna 20 better. In other embodiment, the metal foil should be attached on an metal plane inside the electric device.

The connecting element 22 extends from the first side edge 210 of the grounding element 21 and is bent more than two times to form a three-dimensional structure. The connecting element 22 has a first end connected to the grounding element 21 and a second end apart from the grounding element 21. The connecting element 22 comprises a first arm 220 extending from the first side edge 210 of the grounding element 21, an inflectional second arm 222 extending from the first arm 220. The second arm 222 extends in three dimensions and forms U-shaped configuration. The second arm 222 comprises a first segment 2220, a second segment 2222 and a third segment 2224 defining a beginning portion 22242 connected to the second segment 2222 and an end portion 22240 opposite to the beginning portion 22242. The connecting element 22 has a length and a width along a horizontal plane which are respectively no more than a length and a width of the grounding element 21. A slot 24 is formed between the second arm 222 of the connecting element 22 and the grounding element 21. The slot 24 is of U-shaped configuration for adjust the impedance of the antenna 20.

Figure 4:
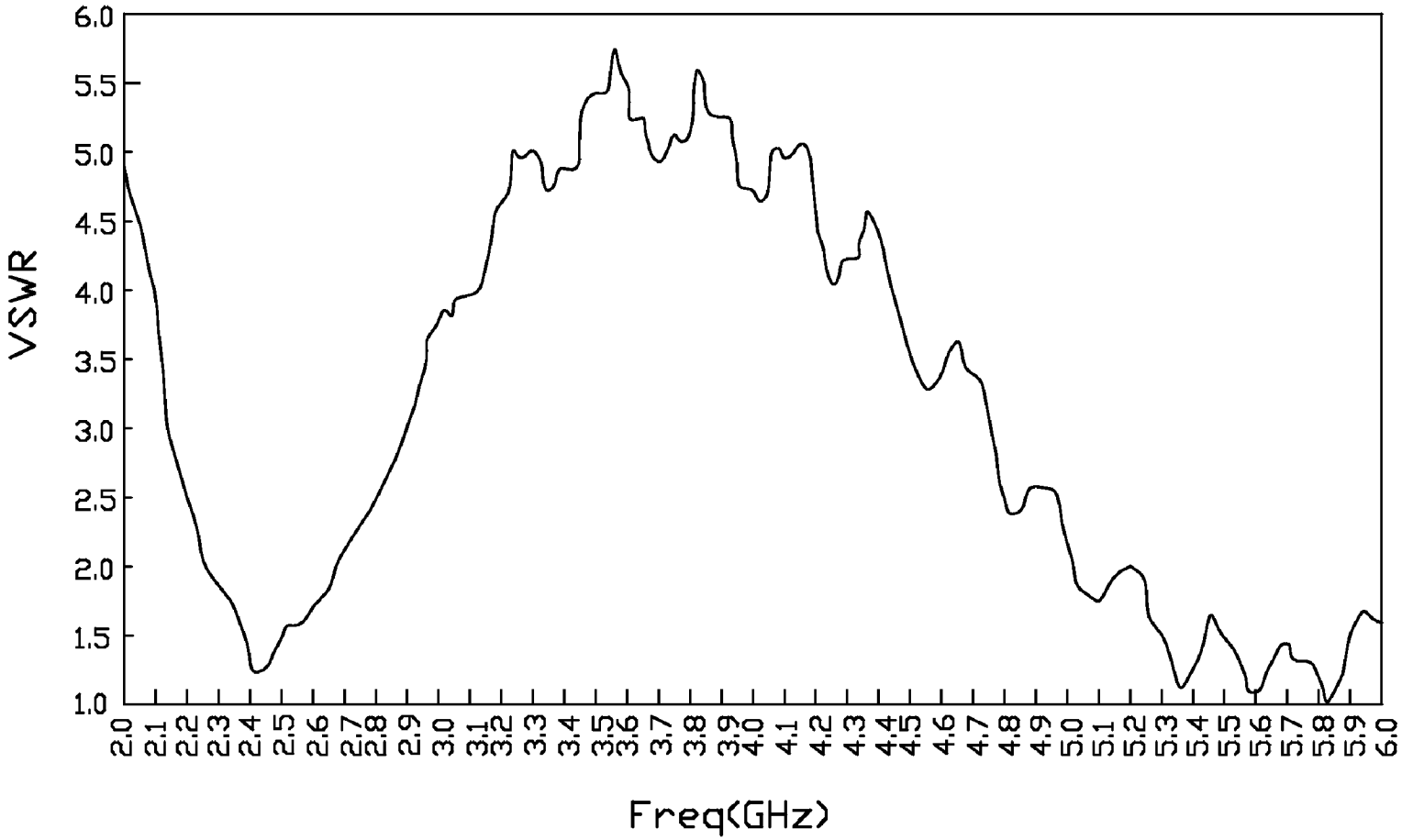
FIG. 4 is a test chart recording for an antenna of the antenna assembly of FIG. 1, showing Voltage Standing Wave Ratio (VSWR) as a function of UWB frequency.

The radiating element 23 comprises a first radiating portion 230 extending upwardly from the end portion 22240 of the third segment 2224 of the connecting element 22 to form a free end 2306, and a second radiating portion 232 extending upwardly from the beginning portion 22242 of the connecting element 22 to form a free end 2326. In this embodiment, the two free ends of the first radiating portion 230 and the second radiating portion 232 extend along the same direction. And in other embodiment, the two ends can also respectively extend along different directions. The first radiating portion 230 is located on the same plane with the third segment 2224 and of L-shaped configuration. The second radiating portion 232 is of tridimensional L-shaped configuration and comprises a first radiating arm 2320 located on the same plane with the third sided arm 2224 of the connecting element 22, and a second radiating arm 2322 extending from the first radiating arm 2320 along a direction perpendicular to the grounding element 21. The first radiating arm 230 is shorter than and below the second radiating portion 232. The first radiating arm 230 is between the second radiating portion 232 and the grounding element 21. The grounding element 21 has substantially a length equal to the second radiating arm 2232. In this embodiment, the first radiating portion 230 is used to receive and send higher frequency band signals, the second radiating portion works on lower frequency band. Referencing to FIG. 4, the antenna 20 operates at 2.3-2.7 GHz and 5.0-6.0 GHz.

The feeding line 30 comprises an inner conductor 31 and an outer conductor 32. The inner conductor 31 is connected to the end portion 22240 of the third segment 2224 of the connecting element 22 to form a feeding point 214. The outer conductor 32 is connected to the grounding element 21 to form a grounding point 216. In other embodiment, the feeding point 214 can be moved to other positions to match the impedance of the antenna 20 and driving point impedance.

The supporting portion 10 is designed according to the antenna 20 so that the antenna 20 can be attached on the supporting portion 10. In this embodiment, the grounding element 21 is attached on a lower surface of the supporting portion 10 and the second radiating arm 2322 of the second radiating portion 232 is attached on an upper surface of the supporting portion 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a grounding element having a side edge;

a connecting element; and a radiating element electrically connected to the grounding element via the connecting element, and comprising a first radiating portion and a second radiating portion respectively extending from the connecting element;

said connecting element comprising a folded connecting arm extending along three dimensions, a slot being formed between the connecting arm and the grounding element;

wherein said grounding element extends along horizontal directions;

wherein said connecting element further comprises a first arm extending from the side edge of the grounding element, and the folded connecting arm forms a second arm of the connecting element.

2. The multi-band antenna as claimed in claim 1, wherein said second arm is of U-shaped configuration and extends from the first arm.

3. The multi-band antenna as claimed in claim 2, wherein said slot is of U-shaped configuration.

4. The multi-band antenna as claimed in claim 1, wherein said second arm of the connecting element comprises a first segment, a second segment extending from the first segment and a third segment extending from the second segment, said third segment comprising a beginning portion connected to the second segment and an end portion opposite to the beginning portion.

5. The multi-band antenna as claimed in claim 4, wherein said first radiating portion is of planar L-shaped configuration and extends from the second end on the third segment of the connecting element.

6. The multi-band antenna as claimed in claim 4, wherein said second radiating portion is of tri-dimensional L-shaped configuration and comprises a first radiating arm extending from the beginning portion of the third segment of the connecting element and a second radiating arm extending from the first radiating arm along a direction perpendicular to the first radiating arm.

7. The multi-band antenna as claimed in claim 6, wherein said connecting element, said first radiating portion and the first radiating arm of the second radiating portion are all perpendicular to the grounding element, and said second radiating arm is parallel to the grounding element.

8. The multi-band antenna as claimed in claim 1, wherein said connecting element has a length and a width along a horizontal plane which are respectively not greater than a length and a width of the grounding element.

9. The multi-band antenna as claimed in claim 1, wherein said first radiating portion works on a higher frequency band and the second radiating portion works on a lower frequency band, and said first radiating portion is between the second radiating portion and the grounding element.

10. The multi-band antenna as claimed in claim 1, wherein said multi-band antenna further comprises a feeding line, and said feeding line comprises an inner conductor and an outer conductor.

11. The multi-band antenna as claimed in claim 10, wherein said inner conductor is connected to the third segment of the connecting element.

12. The multi-band antenna as claimed in claim 1, wherein each of said first and second radiating portion comprises a free end, said two free ends extending along the same direction.

13. The multi-band antenna as claimed in claim 1, further comprises an insulative support portion, the folded connecting arm of the connecting element surrounding at least partially the support portion.

14. The multi-band antenna as claimed in claim 13, wherein said radiating element extends upward from the connecting element to cooperate with the grounding element and the connecting element to enclose said support portion under condition that all said grounding element, said connecting element and said radiating element abut against said support portion.

15. The multi-band antenna as claimed in claim 14, wherein said support portion defines an elongated cutout above said grounding element, and said radiating element is essentially higher than said cutout.

16. The multi-band antenna as claimed in claim 14, wherein said support portion defines an outer oblique side and an inner vertical side communicating with each other via at least one through hole.

17. The multi-band antenna as claimed in claim 14, wherein said connecting element abuts against two sides of the support portion, and said radiating element abuts against other two sides of the support portion.

18. A multi-band antenna, comprising:

a grounding element having a side edge;

a connecting element; and a radiating element electrically connected to the grounding element via the connecting element, and comprising a first radiating portion and a second radiating portion respectively extending from the connecting element;

said connecting element comprising a folded connecting arm extending along three dimensions including a first segment, a second segment and a third segment, a slot being formed between the connecting arm and the grounding element;

wherein said multi-band antenna further comprises a feeding line, and said feeding line comprises an inner conductor and an outer conductor;

wherein said inner conductor is connected to the third segment of the connecting element.

19. A multi-band antenna, comprising:

a grounding element having a side edge;

a connecting element; and a radiating element electrically connected to the grounding element via the connecting element, and comprising a first radiating portion and a second radiating portion respectively extending from the connecting element;

said connecting element comprising a connecting arm extending along three dimensions, a slot being formed between the connecting arm and the grounding element;

further comprises an insulative support portion, the connecting arm of the connecting element surrounding at least partially the support portion;

wherein said radiating element extends upward from the connecting element to cooperate with the grounding element and the connecting element to enclose said support portion under condition that all said grounding element, said connecting element and said radiating element abut against said support portion.

20. The multi-band antenna as claimed in claim 19, wherein said connecting element is in a folded manner to include a first segment, a second segment and a third segment respectively on three different sides of the support portion.

* * * * *